US005386941A

United States Patent [19]

Haynes

[11] Patent Number: 5,386,941

[45] Date of Patent: Feb. 7, 1995

[54] FLUID INJECTION DEVICE AND METHOD

[76] Inventor: Henry T. Haynes, 105 E. G St., Jenks, Okla. 74037

[21] Appl. No.: 176,801

[22] Filed: Dec. 30, 1993

Related U.S. Application Data

[63] Continuation-in-part of Ser. No. 46,646, Apr. 13, 1993, Pat. No. 5,284,298.

[51] Int. Cl.[6] ..... B05B 7/00

[52] U.S. Cl. ..... 239/427.3; 239/429; 239/430; 239/431; 239/434

[58] Field of Search ..... 239/8, 427, 427.3, 429–431, 239/433–434.5, 589, 590, 590.5, 251; 134/179

[56] References Cited

U.S. PATENT DOCUMENTS

| | | | |
|---|---|---|---|
| 486,829 | 11/1992 | Hart | 239/259 |
| 3,180,348 | 4/1965 | Clearman | 239/251 |
| 3,807,636 | 4/1974 | Fackler | 239/251 |
| 4,191,590 | 3/1980 | Sundheim | 239/251 |
| 4,923,120 | 5/1990 | Hammelmann | 134/179 |

FOREIGN PATENT DOCUMENTS

| | | | |
|---|---|---|---|
| 829648 | 1/1952 | Germany | 239/434 |

*Primary Examiner*—Andres Kashinikow
*Assistant Examiner*—Lesley D. Morris
*Attorney, Agent, or Firm*—Dougherty, Hessin, Beavers & Gilbert

[57] ABSTRACT

A fluid injection device and method includes an upstream conduit, downstream conduit, a support for holding the upstream and downstream conduit with their upstream and downstream passageways aligned and maintaining a gap between the adjacent ends of the conduits, and a secondary fluid source connectable to the gap for injecting secondary fluid into the gap and downstream throat. The upstream passageway includes an acceleration nozzle for accelerating the velocity of the fluid flow so that the pressure exerted by the fluid on the walls of the upstream passageway is substantially reduced and the reduced pressure is maintained across the gap. The downstream conduit includes a downstream passageway which maintains the accelerated velocity of the primary fluid and which conducts the accelerated fluid to a deceleration nozzle. The secondary fluid source injects secondary fluid into the gap and downstream conduit at a preselected higher pressure than the fluid exiting the upstream throat. The secondary fluid source may be used to cool, inject additives, and add volume and/or mass to the fluid exiting the upstream conduit. A plurality of the injection devices may be connected in series and/or multiple gaps may be created between the upstream and downstream conduits using intermediate conduits in order to stage or sequence the injection of secondary fluid.

71 Claims, 4 Drawing Sheets

FLUID INJECTION DEVICE AND METHOD

This application is a continuation-in-part of application Ser. No. 08/046,646, filed on Apr. 13, 1993 now U.S. Pat. No. 5,234,298.

BACKGROUND OF THE INVENTION

This invention relates to fluid injecting and mixing devices and methods and, more particularly, but not by way of limitation, to such a device and method which will inject relatively low pressure fluids into relatively high pressure fluids.

Devices for mixing a lower pressure secondary fluid into a higher pressure primary fluid are known and are commercially available. Typical of such devices are jet pumps. Jet pumps are not injection devices but are ingestion or inspiration devices in that they create a vacuum and use the vacuum to pull the secondary fluid into the primary fluid. This is accomplished at a significant energy expenditure in the form of pressure loss. A typical jet pump drops or loses 30% or more of the inlet pressure of the primary fluid in ingesting the additive or secondary fluid and also loses a significant percentage of the fluid velocity in accomplishing the ingestion.

The devices and methods for injecting a relatively low pressure secondary fluid into a relatively high pressure primary fluid known to the applicant require either pumping or compressing the secondary fluid to the pressure of the primary fluid or reducing the pressure of the primary fluid, either of which requires a relatively high expenditure of energy.

Therefore, there is a need for an injection and mixing device and method which will mix a relatively low pressure secondary fluid with a relatively high pressure primary fluid at a greater energy efficiency. There is a need for such a device which will inject a relatively low pressure secondary fluid into a relative high pressure primary fluid, increase the mass flow of the fluid downstream of the injection point, and substantially maintain the fluid velocity, all at a relatively low energy loss in the overall recovered downstream mass flow. There is a need for such a device which may be used to cool a high temperature, pressurized primary fluid by injecting a cooler, relatively low pressure secondary fluid at a high energy efficiency. There is also a need for such a device which may be used to cool high temperature, high pressure primary fluids which contract when cooled, such as combustion gases, while adding mass to the primary fluid by injecting a relatively low pressure, cooler fluid into the thermally contracting primary fluid. There is also a need for such a device which may be used to improve the efficiency of pressure-driven engines and generators. There is also a need for such a device which is relatively inexpensive to manufacture and maintain.

SUMMARY OF THE INVENTION

The present invention is contemplated to overcome the foregoing deficiencies and meet the above-described needs. In accomplishing this, the present invention provides a novel and improved fluid injection device and method.

The inventive fluid injection device includes an upstream conduit, a downstream conduit, support means, and a secondary fluid source. The upstream conduit has a first end connectable to a primary fluid source, a second end, and an upstream passageway extending through the first and second ends. The upstream passageway includes an acceleration nozzle disposed in the upstream passageway for accelerating the velocity of the fluid flow in the upstream passageway so that the pressure exerted by the primary fluid on the walls of the upstream passageway is substantially reduced; and an upstream throat, extending between the acceleration nozzle and the second end of the upstream conduit, for maintaining the accelerated velocity of the fluid flow from the acceleration nozzle.

The downstream conduit has a first end connectable to a fluid user, a second end, and a downstream passageway extending through the first and second ends. The downstream passageway includes a deceleration nozzle disposed in the downstream passageway for decelerating the velocity of the fluid flow; and a downstream throat extending between the deceleration nozzle and the second end of the downstream conduit for receiving the accelerated fluid from the upstream throat and the injected secondary fluid and maintaining the received fluids at substantially the same velocity as the velocity of the primary fluid exiting the upstream throat.

The support means is used for holding the upstream and downstream conduits with the upstream and downstream throats aligned and for maintaining a gap between the upstream and downstream conduits and between the upstream and downstream throats. The secondary fluid source is connectable to the gap for injecting a secondary fluid into the gap and downstream throat at a preselected higher pressure than the primary fluid exiting the upstream throat. Because the acceleration nozzle reduces the pressure of the primary fluid by increasing the velocity of the fluid, and the increased velocity and reduced pressure of the primary fluid is maintained across the gap(s), a secondary fluid source at a lower pressure than the primary fluid source may be used to inject secondary fluid into the gap and primary fluid. The support means may also allow rotation of one or both of the upstream and downstream conduits.

Several of the injection devices may be connected in series. Also, an intermediate conduit may be placed between the upstream and downstream conduits. The intermediate conduit has an intermediate throat extending between an inlet end and an outlet end. The inlet end of the intermediate conduit receives the accelerated fluid from the upstream throat and the injected fluid and maintains the received fluids at substantially the same velocity through the intermediate throat as the primary fluid exiting the upstream conduit. A support means is used to hold the intermediate conduit with the inlet end of the intermediate throat aligned with the upstream throat and the outlet end of the intermediate throat aligned with the downstream throat. The support means is also used to maintain a gap between the upstream and intermediate conduits and throats as well as a gap between the downstream and intermediate conduits and throats. A plurality of intermediate conduits may be placed in series between the upstream and downstream conduits. The secondary fluid source is connectable to the gaps between the conduits for injecting secondary fluid into the gaps.

In one embodiment, the primary fluid is relatively hot and the secondary fluid is relatively cool and the primary fluid exiting the upstream throat volumetrically contracts when cooled by the injected secondary fluid. The volume and pressure of the secondary fluid source are selected so that the injected secondary fluid replaces the volume of primary fluid lost due to thermal contraction and thereby increases the mass of fluid flowing through the downstream throat relative to the upstream throat. The pressure and volume of the secondary fluid source may also be selected to inject a greater volume of secondary fluid into the downstream throat than the volumetric contraction of the primary fluid and the cross-sectional areas of the downstream throat and passageway selected or sized to maintain the flow of the primary and injected secondary fluids through the downstream throat at substantially the same velocity as the primary fluid exiting the upstream throat.

When the primary fluid is not relatively hot, or does not volumetrically contract when cooled, the secondary fluid source may be used to inject secondary fluid into the primary fluid and downstream throat and increase the volume and mass of the fluid passing through the downstream throat. The cross-sectional areas of the downstream throat and passageway are selectively enlarged or sized to accommodate the increased volume and mass of fluid in the downstream throat and to maintain the flow of the fluid through the downstream throat at substantially the same velocity as the primary fluid exiting the upstream throat.

When a plurality of the fluid injection devices are connected in series, or one or more intermediate conduits are disposed between the upstream and downstream conduits, the secondary fluid source may be used to inject additional volume and/or mass into the primary fluid at each gap and the throat(s), passageway(s), nozzle(s), etc. downstream of each gap should be appropriately sized to maintain the flow of fluid at substantially the same velocity as the primary fluid exiting the upstream throat. In all of the previously discussed embodiments, the fluid user should be sized to allow flow of the primary and secondary fluids through the injection and mixing device without creating a back pressure or vacuum which would interfere with the operation of the invention.

It is an advantage of the present invention to provide an injection and mixing device and method which will mix a relatively low pressure secondary fluid with a relatively high pressure primary fluid at a relatively high energy efficiency and savings.

It is an advantage of the present invention to provide such a device and method which will inject a relatively low pressure secondary fluid into a relatively high pressure primary fluid, increase the mass flow of the fluid downstream of the injection point, and substantially maintain the fluid velocity, all at a relatively low energy loss in the overall recovered mass flow.

It is an advantage of the present invention to provide such a device and method which may be used to cool high temperature pressurized fluids by injecting a cooler relatively low pressure fluid into the higher temperature fluid at a relatively high energy efficiency and savings.

It is an advantage of the present invention to provide such a device which may be used to more efficiently cool high temperature, high pressure fluids which contract when cooled and to add mass to the high temperature fluid by injecting a relatively low pressure, cooler fluid into the thermally contracting primary fluid.

It is an advantage of the present invention to provide such a device which may be used to more efficiently add mass to high temperature, high pressure fluids while cooling the high temperature fluid to an environmentally acceptable level.

It is an advantage of the present invention to provide a more energy-efficient method of cooling combustion gases from a sufficiently high temperature combustion that the environmentally damaging by-products, typical of combustion gases, are virtually eliminated by the high temperature of the combustion.

It is an advantage of the present invention to provide an injection-type cooling device which may be relatively inexpensively manufactured of materials capable of cooling fluids existing at temperatures above the economical limits of prior known cooling devices.

It is an advantage of the present invention to provide an injection device and method which may be used to improve the efficiency of pressure driven engines and generators.

It is an advantage of the present invention to provide such a device which is relatively inexpensive to manufacture and maintain.

BRIEF DESCRIPTION OF THE DRAWINGS

The present invention will be better understood by reference to the example of the following drawings.

DETAILED DESCRIPTION OF THE PREFERRED EMBODIMENTS

Figure 1:
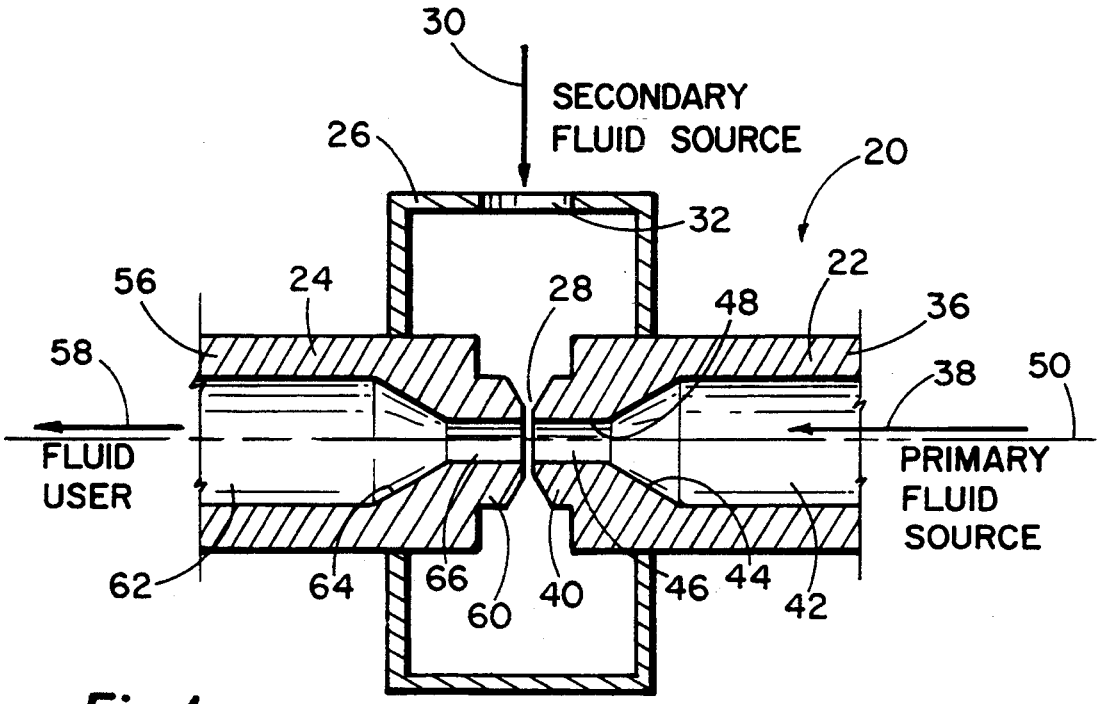
FIG. 1 is a schematic diagram of an embodiment of a fluid injection device of the present invention.

Preferred embodiments of the invention will now be described with reference to the drawings. Like reference characters refer to like or corresponding parts throughout the drawings and description.

FIGS. 1–6 present embodiments of the fluid injection device and method, generally designated 20, of the present invention. Although the invention is generally referred to herein as an injection device, it is intended to be understood that the invention has several utilitarian aspects which include applications as a mixing device, fluid adding device, cooling device, mass augmenting device, and engine driving device, as well as the methods of using the same. More specific utilitarian applications include precision injection of fuel into a high pressure combustion air supply, injecting water to increase the liquid mass and lower the temperature of superheated steam, use as a replacement for the intercoolers in a compression system in order to add mass to the compressed fluid and increase the efficiency of the compression system, and maintaining the composition of a fluid, such as a nitrogen blanket, by injecting pure nitrogen in an energy efficient manner and thereby reducing the relative impurity levels. The injection device 20 may also be used in combination with the fluid conducting swivel and method described in U.S. Pat. No.

5.294,298, which is incorporated herein for purposes of disclosure.

Figure 4:
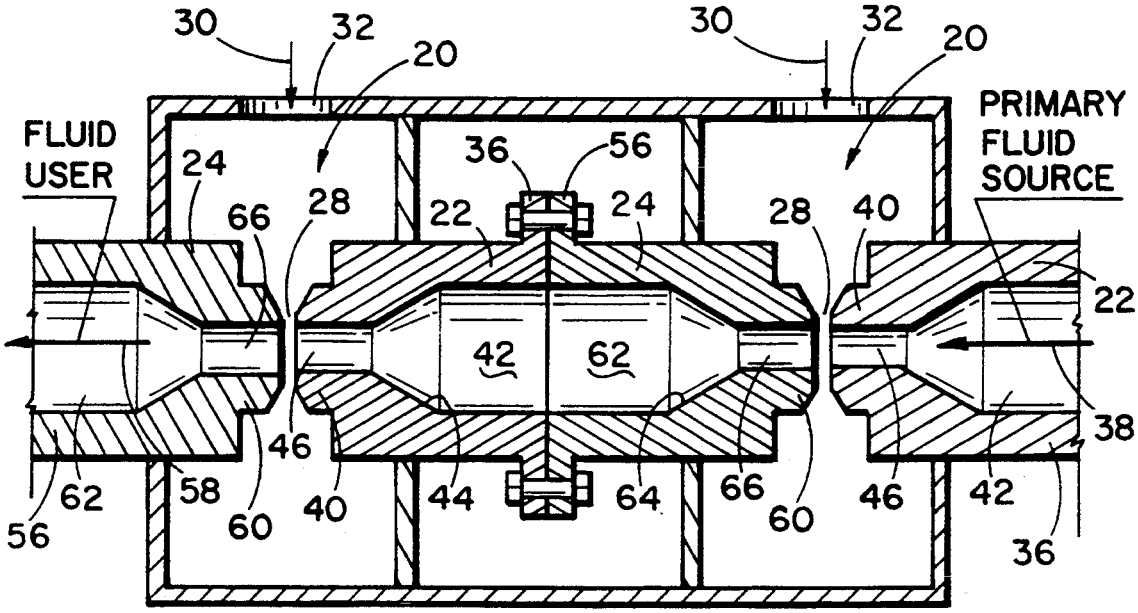
FIG. 4 is a sectional schematic diagram of another embodiment of the fluid injection and mixing device of the present invention.
Figure 3:
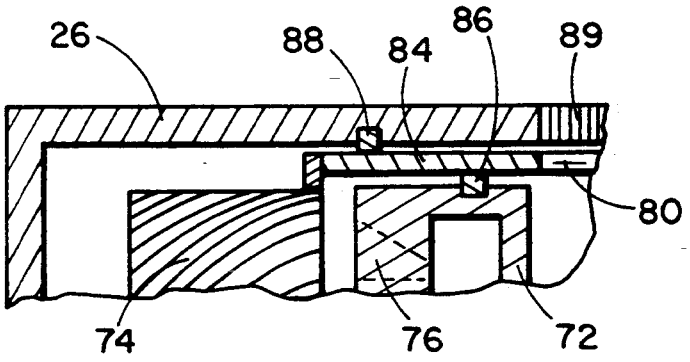
FIG. 3 is an enlarged sectional view of a portion of FIG. 2 illustrating an embodiment of a sealing arrangement between the thrust rotor, secondary rotor, and housing.

Referring to the example of FIG. 1, the fluid injection device 20 may be generally described as including an upstream conduit 22, a downstream conduit 24, support means 26 for holding the upstream and downstream conduits 22, 24 in alignment and for maintaining a space or gap 28 between the upstream and downstream conduits 22, 24, and a secondary fluid source 30 connectable to the gap for injecting secondary fluid into the gap 28 (through orifice 32 in the examples of FIGS. 1, 3, and 4).

Referring to the example of FIG. 1, the upstream conduit 22 has a first end 36 connectable to a primary fluid source 38, a second end 40, and an upstream passageway 42 extending through the first and second ends 36, 40. The upstream passageway 42 also includes an acceleration nozzle 44 disposed in the upstream passageway 42 for accelerating the velocity of fluid flow through the upstream passageway 42 and an upstream throat 46 which extends between the acceleration nozzle 44 and the second end 40 of the upstream conduit 22 for maintaining the accelerated velocity of the fluid flow from the acceleration nozzle 44. The acceleration nozzle 44 and upstream throat 46 may be integral with or separate from the upstream conduit 22 and passageway 42.

The acceleration nozzle 44 reduces the size of the upstream passageway 42 and thereby provides a means for accelerating the velocity of the fluid flow to such a velocity that the pressure exerted by the primary fluid on the walls 48 of the upstream passageway 42 is substantially reduced, and preferably is reduced to such a point that the primary fluid exerts substantially no pressure on the walls 48 of the upstream throat 46. The acceleration nozzle 44 may also be described as providing a means for reducing the size of the upstream passageway 42 and thereby accelerating the velocity of the primary fluid flow to such a velocity that the fluid creates a substantially self-contained fluid jet which exerts little or no radially outward pressure and has little dissociation, particularly at points on the fluid jet in close proximity to its discharge from the second end 40 of the upstream conduit, as does a nozzle on a garden hose or high pressure air hose.

The preferred upstream throat 46 has a substantially constant cross-sectional area (in radial cross-section with respect to the axis 50) in order to maintain the accelerated velocity of the fluid flow and to maintain the self-contained fluid jet created by the acceleration nozzle 44. Preferably, the acceleration nozzle 44 is frusto-conically shaped (in axial cross-section), converges in the direction of fluid flow, and the converging walls at the nozzle 44 form an angle of 60° or less with the axis 50 of the upstream passageway 42 and upstream throat 46. The preferred upstream throat 46 maintains the reduced size of the upstream passageway 42 created by the acceleration nozzle 44 and extends the reduced size to the upstream conduit second end 40.

The downstream conduit 24 has a first end 56 connectable to a fluid user 58, a second end 60, and a downstream passageway 62 extending through the first and second ends 56, 60. The downstream passageway 62 also includes a deceleration nozzle 64 disposed in the downstream passageway 62 for decelerating the velocity of the fluid flow through the downstream passageway 62 (and thereby preventing the development of back pressure at the gap 28) and a downstream throat 66 which extends between the deceleration nozzle 64 and the second end 60 of the downstream conduit 24. The deceleration nozzle 64 and downstream throat may be integral with or separate from the downstream conduit 24 and passageway 62.

The downstream throat 66 provides a means for receiving the accelerated fluid from the upstream throat 46 and the injected secondary fluid and maintaining the received primary and injected fluids at substantially the same velocity as the velocity of the primary fluid exiting the upstream throat 46. The downstream throat 66 receives the substantially self-contained fluid jet from the upstream throat 46 before the discharged fluid jet has time to substantially expand or dissociate and is sized (in radial cross-section) to prevent expansion of the stream inside the throat 66 as well as accommodate the injected secondary fluid.

The cross-sectional shape and area of the downstream throat is selected or sized to maintain the primary and injected fluids at substantially the same velocity as the velocity of the primary fluid exiting the upstream throat. The cross-sectional area of the downstream throat 66, deceleration nozzle 64, and downstream passageway 62 may be increased with increases in the volume of the primary fluid due to the injected secondary fluid in order to maintain the fluid velocity in the downstream throat 66, as would be known to one skilled in the art in view of the disclosure contained herein. The downstream passageway 62 and fluid user 58 should be selected or sized to allow fluid flow through the downstream conduit 24 without sufficient restriction to cause back pressure in the downstream throat 66 and gap 28.

The deceleration nozzle 64 provides a means for enlarging the size of the downstream passageway 62 and thereby decelerates the velocity of the fluid flow through the passageway 62. The preferred deceleration nozzle 64 is frusto-conically shaped (in axial cross-section), diverges in the direction of flow, and has walls 64 which form an angle of 60° or less with the flow axis 50 of the downstream throat 66. Preferably, the acceleration and deceleration nozzles 44, 64 are substantially identical in design and equidistantly placed from the second ends 40, 60 of the upstream and downstream conduits 22, 24; although the nozzles 44, 66 may be placed at different distances from the second ends 40, 60, i.e., the throats 46, 66 may be of different lengths. In the prototype device 20, the nozzles 44, 64 and upstream and downstream throats 46, 66 are substantially symmetrical in axial cross-section, as exemplified in FIG. 1.

The gap 28, i.e., the distance between the second ends of the upstream and downstream conduits 22, 24 and throats 46, 66 will be determined or sized, based upon the circumference of the inside diameter of the downstream throat 66, volume of secondary fluid to be injected, and pressure of the secondary fluid source 30, to prevent dissociation of the primary fluid and to allow injection of the volume of secondary fluid needed to maintain the fluid at a constant velocity in the throat 66 downstream of the gap 28, as would be known to one skilled in the art in view of the disclosure contained herein. The outside surfaces of the adjacent second ends 40, 60 of the upstream and downstream conduits 22, 24 may be beveled or otherwise shaped to facilitate the injection of secondary fluid, as exemplified in FIGS. 1–4. The sizing of the gap 28 should account for expansion characteristics of the materials of which the device 20 is constructed and allow for thermal expansion and contraction of the materials at the operating temperatures of the device 20.

In a preferred embodiment, the pressure and volume or capacity of the secondary fluid source 30 are selected or sized to inject secondary fluid into the primary fluid and downstream throat 66 via the gap 28 and to increase the volume and mass of the fluid passing through the downstream throat 66, i.e., the addition of the injected secondary fluid to the primary fluid increases the volume and mass in the downstream throat 66. The cross-sectional area of the downstream throat 66, nozzle 64, and passageway 62 should be selectively enlarged (i.e., sized or designed) to accommodate the increased volume and mass of fluid in the downstream throat 66 and to maintain the flow of the fluid through the downstream throat 66 at substantially the same velocity as the primary fluid exiting the upstream throat 46. This embodiment is particularly appropriate when the primary fluid is not relatively hot and/or does not contract if cooled by the secondary fluid. Since the primary fluid does not contract, the downstream throat 66, nozzle 64, and passageway 62 should be enlarged as required to accommodate the addition of the injected secondary fluid to the primary fluid. It is contemplated that this embodiment will be particularly advantageous in situations where it is desired to add or mix conditioners, cleaning fluids, chemicals, and the like to a relatively high pressure primary fluid without having to compress or pump the secondary fluid to the pressure of the primary fluid source. (A relatively small amount of secondary fluid may be injected without increasing the area of the downstream throat 66, depending primarily upon the pressure of the secondary fluid source 30. It is contemplated that, with a noncontracting or incompressible primary fluid, the maximum quantity of secondary fluid which may be injected without increasing the size of the downstream throat 66, nozzle 64, and passageway 62 will create an approximately 4 to 5% flow increase.)

In another preferred embodiment, the primary fluid is relatively hot and the secondary fluid is relatively cool and the primary fluid exiting the upstream throat 46 volumetrically contracts when cooled by the injected secondary fluid. The volume and pressure of the secondary fluid source 30 may be selected so that the injected secondary fluid replaces the volume of primary fluid lost due to thermal contraction and thereby increases the mass of fluid flowing through the downstream throat 66 relative to the upstream throat 46. The volume and pressure of the secondary fluid source 30 should be selected to maintain the flow of the primary and injected secondary fluids through the downstream throat at substantially the same velocity as the primary fluid exiting the upstream throat 46. Also, the cross-sectional areas of the downstream throat 66, nozzle 64, and passageway 62 should be selected to maintain the flow of the primary and injected secondary fluids through the downstream throat 66 at substantially the same velocity as the primary fluid exiting the upstream throat 46 and cross the gap 28. The selection or sizing of the volume and pressure of the secondary fluid source 30 and the cross-sectional areas of the downstream throat 66, nozzle 64, and passageway 62 will normally be mutually dependent and it is contemplated that the cross-sectional areas of the downstream throat 66 and passageway 62 will normally be sized based upon the pressure and capacity of the secondary fluid source 30, and taking into account the thermal contraction of the primary fluid, as would be known to one skilled in the art in view of the disclosure contained herein. The pressure and capacity of the secondary fluid source 30 should be sufficient to maintain a positive pressure in the gap 28 and to prevent dissociation of the primary fluid exiting the adjacent upstream throat 46.

Figure 2:
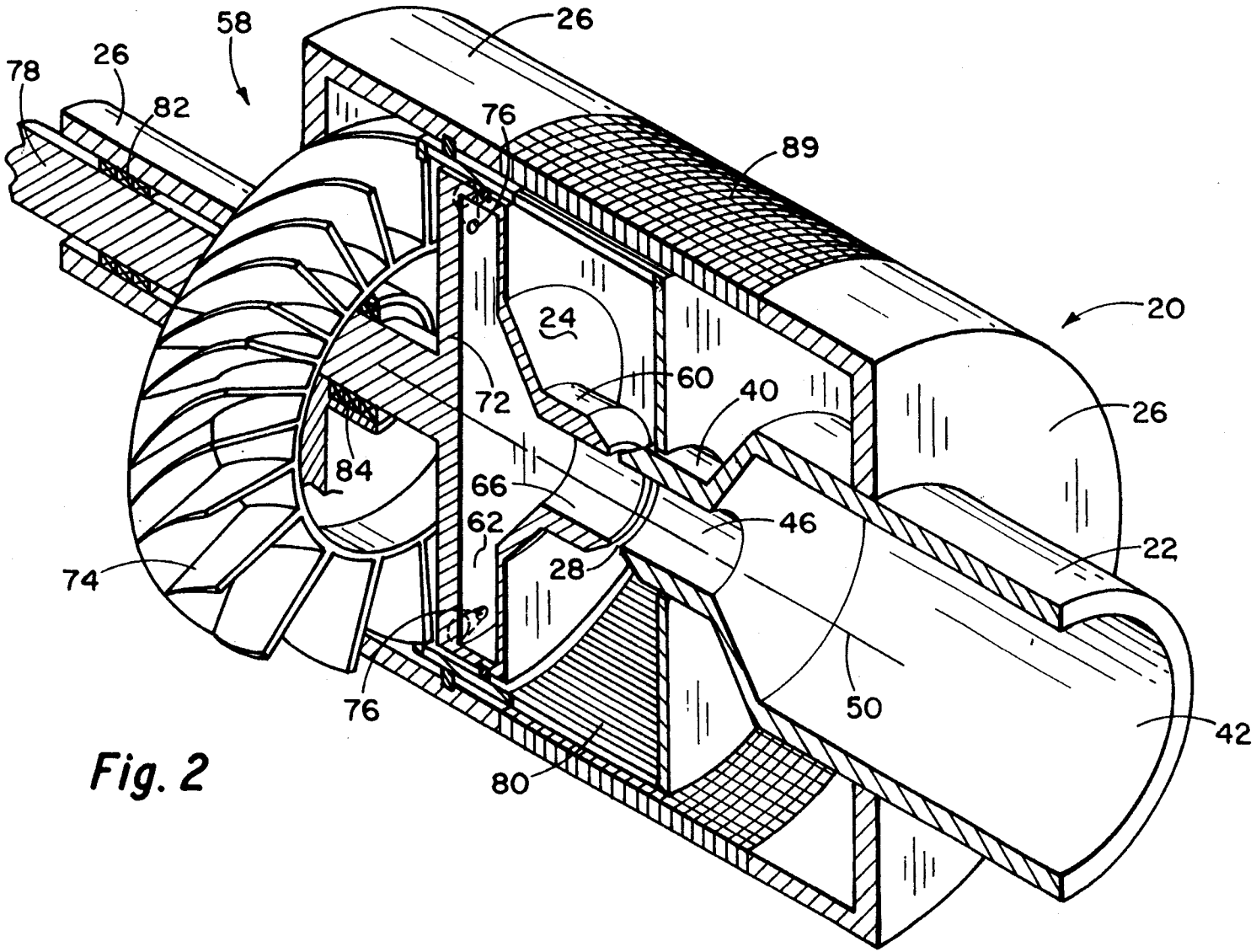
FIG. 2 is a sectional perspective view of a contemplated embodiment of the present invention in a combustion-gas-driven engine.

The pressure and volume of the secondary fluid source 30 may be selected to inject a greater volume of secondary fluid into the downstream throat 66 than the thermal, volumetric contraction of the primary fluid. In such a situation, the downstream throat 66, nozzle 64, passageway 62, and the fluid user 58 should be selected to maintain the flow of primary and injected secondary fluids through the downstream throat 66 at substantially the same velocity as the primary fluid exiting the upstream throat 46. This embodiment, in which the primary fluid thermally contracts, utilizes the thermal contraction of the primary fluid to inject additional mass and volume into the downstream throat 66 at a substantial energy savings over injecting additional fluid into the primary fluid source 38 since, because of the reduced pressure of the primary fluid in the gap 28, the pressure of the secondary fluid source 30 may be considerably less than the pressure of the primary fluid source 38 and allow the injection of the secondary fluid at an energy savings. It is contemplated that this embodiment will be particularly advantageous as a source of high pressure fluids for a pressure driven engine. Referring to the example of FIG. 2, the support means may be selected or designed to allow rotation of either or both of the upstream and downstream conduits 22, 24. The upstream and/or downstream conduits 22, 24 may be mechanically rotated by an externally powered rotational drive system, as would be known to one skilled in the art. In the example of FIG. 2, the downstream conduit 24 rotates with the thrust rotor 72. The example fluid user 58 includes thrust rotor 72 and secondary rotor 74. The thrust rotor 72 includes at least one thrust nozzle 76 which is disposed and directed for discharging the fluid exiting the downstream conduit 24 and causing rotation of the downstream conduit 24. In the prototype, the thrust nozzle 76 is displaced radially with respect to the axis 50 of the downstream throat 66 and is directed downstream along an axis that is skewed with respect to the axis 50 and lies in a plane parallel to the axis 50 in order to cause rotation of the thrust rotor 72 about the axis 50. The distance between the axis 50 and the discharge axis of the thrust nozzle 76, the angle at which the thrust nozzles 76 discharge, the number of nozzles 76, and the size of the nozzles 76 may be selected to control the thrust force imparted to the thrust rotor 72, as would be known to one skilled in the art in view of the disclosure contained herein. Exhaust ports or venting (not illustrated) should be provided in the housing 26 to discharge the fluid exhausted from the secondary rotor 74.

Transfer means 78 is provided for transferring the rotational energy of the thrust rotor 72 to an energy user. In the example of FIG. 2, the transfer means 78 is a rotary drive shaft 78 connected to the thrust rotor 72. Bearings 82 are provided between the rotary drive shaft 78 and the support means 26 to allow rotation of the rotary drive shaft 78 and to support the rotary drive shaft 78 and thrust rotor 72. Similarly, suitable bearings 84 should be provided to rotatably support the secondary rotor 74 and intake fan 80 from the support means/housing 26, as would be known to one skilled in the art in view of the disclosure contained herein.

In the example of FIG. 2, the secondary rotor 74, which may be a turbine, rotary vane device, or the like, is rotated by the fluid exhausted from the thrust nozzle(s) 76. The preferred secondary rotor 74 is connected to and rotates the intake fan 80 which acts as the secondary fluid source 30 and injects pressurized, cooling air into the gap 28. FIG. 3 exemplifies the connection of the secondary rotor 74 to the intake fan 80. The intake fan 80 exemplified in FIGS. 2 and 3 is a squirrel-cage-type fan 80 which is connected to the secondary rotor with cylindrical cowling 84. The cylindrical cowling 84 is not perforated and a seal 86 extends around the outside diameter of the thrust rotor 72 and rotatably seals against fluid passage between the thrust rotor 72 and cowling 84. Seal 86 prevents fluid which is discharged from thrust nozzles 76 from passing around the outside of the thrust rotor 72 to the gap 28. Seal 88 is provided between the outside diameter of the cowling 84 and the inside diameter of the support means/housing 26 to prevent fluid which is discharged through the secondary rotor 74 from passing around the outside of the cowling 84 to the intake fan 80. The seals 86, 88 may be any type of low friction seal which will provide the desired fluid isolation and which are compatible with the fluid temperatures to which they will be exposed and the materials of which the fluid user 58 is constructed. It is contemplated that carbon or metal spring-type ring seals would perform adequately.

As the secondary rotor 74 is rotated by the fluid exhausted from thrust nozzles 76, the secondary rotor 74 rotates the intake fan 80 which pulls air through the screen 89 in the support means/housing 26 and injects the air into the gap 28. The secondary rotor 74 may also be used to supplement and/or supply the power output by rotary drive shaft 78 by using appropriate power transfer configurations, as would be known to one skilled in the art in view of the disclosure contained herein.

The embodiment of FIGS. 2 and 3 is an example of how the invention may be adapted to improve the efficiency of a combustion-gas-driven engine. It is contemplated that the invention would allow the fuel combustion to take place at higher temperatures than currently possible because of the invention's ability to cool the combustion products at the gap 28 in an efficient manner. During cooling at the gap 28, the high temperature combusted gas would thermally contract, allowing the injection of additional mass (in the form of the injected cooling air or other relatively cool secondary fluid). The increased mass downstream of the gap would increase the power available to drive the thrust rotor 72 in a highly efficient manner, since it is the combination of pressure and mass which drives a thrust rotor or turbine (and other pressure-driven engines), and the present invention allows the addition of mass from a relatively low pressure secondary fluid source 30 to the primary fluid at the gap 28. It is contemplated that the thermal volumetric contraction and mass injection will require some energy loss which will not be replaced by the pressure of the secondary fluid source 30, and, based on preliminary calculations, that more than ninety percent (90%) of the total energy of the primary fluid at the primary fluid source 38 will be recovered downstream of the deceleration nozzle 64 after the addition of mass at the gap 28. Depending upon the temperature of the combustion gas, it may be desirable to accelerate the primary fluid/combustion gas to such a velocity that it will create a slight vacuum at the gap 28 (which will normally be filled by injected, cooler secondary fluid) as a safety feature so that if, for example, the intake fan 80 becomes inoperable, the vacuum will pull cooling air into the primary fluid to prevent the hot primary fluid from severely damaging the downstream equipment.

Referring to the example of FIG. 4, a plurality of fluid injection devices 20 may be connected in series in such a manner that the downstream conduit 24 of the adjacent upstream injection device 20 is the source of primary fluid for the upstream conduit 22 of the adjacent downstream injection device 20. It is contemplated that such a staged or sequenced device may be more efficient in adding volume or mass to either a primary fluid which does not contract when injected with a secondary fluid or to a primary fluid which thermally contracts when injected with a cooled secondary fluid. The selection and sizing considerations discussed above for the throat 66, nozzle 64, and passageway 62 downstream of each gap 28 would apply at each gap, i.e., the throat 66, nozzle 64, and passageway 62 downstream of each gap 28 should be sized to maintain the flow of the primary and all secondary fluids which have been injected upstream at substantially the same velocity as the primary fluid exiting the upstream throat 46.

Figure 5:
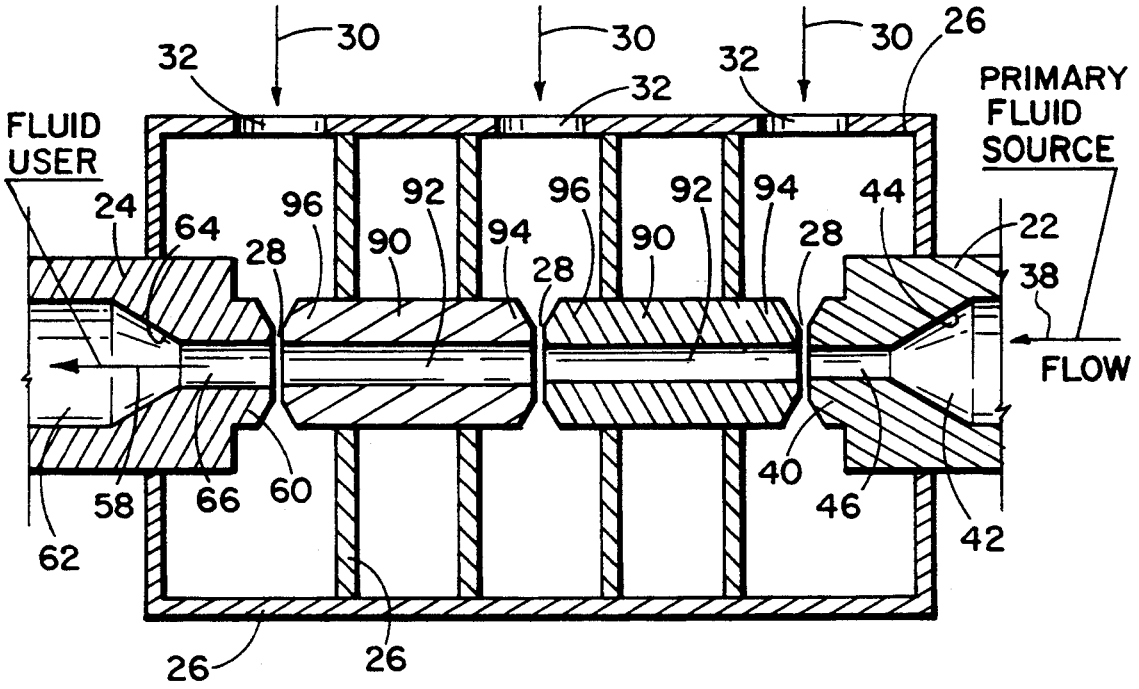
FIG. 5 is a sectional schematic diagram of another embodiment of a fluid injection and mixing device of the present invention.

Referring to the example of FIG. 5, in another embodiment, an intermediate conduit 90 having an intermediate throat 92 extending between an inlet end 94 and an outlet end 96 is disposed between the upstream conduit 22 and the downstream conduit 24. The inlet end 94 of the intermediate conduit 90 receives the accelerated fluid from the upstream throat 46 and the injected secondary fluid. The intermediate throat 92 maintains the received fluids at substantially the same velocity through the intermediate throat 92 as the primary fluid exiting the upstream conduit 22.

The support means 26 holds the intermediate conduit 90 with the inlet end 94 of the intermediate throat 92 aligned with the upstream throat 46 and the outlet end of the intermediate throat 92 aligned with the downstream throat 66 and maintains a gap 28 between the upstream and intermediate conduits 22, 90 and throats 46, 92 and maintains a gap 28 between the downstream and intermediate conduits 24, 90 and throats 66, 92. The secondary fluid source 30 is connectable to the gaps 28 through orifices 32 for injecting secondary fluid into the gaps 28.

As exemplified in FIGS. 4 and 5, the pressure and volume of the secondary fluid source may be selected to inject secondary fluid into the primary fluid, intermediate throat 92 and downstream throat 66 at gaps 28 and increase the volume and mass of the fluid passing through the intermediate and downstream throats 92, 66. The cross-sectional area of the intermediate and downstream throats 92, 66, nozzle 64, and passageway 62 should be selectively enlarged (by appropriate design or sizing), taking into account the pressure, volume, and other relevant conditions of the secondary fluid source 30, to accommodate the increased volume and mass of fluid in the intermediate and downstream throats 92, 66 and to maintain the flow of fluid passing through the intermediate and downstream throats 92, 66 at substantially the same velocity as the primary fluid exiting the upstream throat 46.

As in the previously discussed embodiments, the fluid exiting the upstream and intermediate conduits 22, 90 may be selected and designed to be relatively hot and to volumetrically contract when cooled by the relatively cool injected secondary fluid. The volume and pressure of the secondary fluid source 30 may be selected, sized, or designed so that the injected secondary fluid replaces the volume of fluid lost due to thermal contraction at each gap 28 and thereby increases the mass of fluid flow at each gap 28 through the intermediate and downstream throats 92, 66. The volume and/or capacity and pressure of the secondary fluid source 30 should be selected to maintain the fluid flow velocity through the intermediate and downstream throats 92, 66 at substantially the same velocity as the fluid exiting the upstream throat. Since the pressure of the primary fluid jetting across the gaps 28 has been reduced by the increased velocity of the primary fluid, the pressure of the secondary fluid source 30 may be substantially lower than the pressure of the primary fluid source 38. In conjunction with the capacity, pressure, and other properties of the secondary fluid source 30, the cross-sectional area of each of the intermediate and downstream throats 92, 66 and passageway 62 should be selected to maintain the fluid flow velocity through the intermediate and downstream throats at substantially the same velocity as the fluid exiting the upstream throat.

The volume or capacity and pressure of the secondary fluid source 30 may be selected to inject a greater volume of secondary fluid at each gap 28 than the volume of fluid lost due to thermal volumetric contraction and to thereby increase the mass of fluid flow at each gap 28 through the intermediate and downstream throats 92, 66. In such a case, each of the intermediate and downstream throats 92, 66, nozzle 64, and passageway 62 should be selected (sized and designed) to maintain the flow through the intermediate and downstream throats 92, 66 at substantially the same velocity as the fluid exiting the upstream throat 46.

As exemplified in FIG. 5, a plurality of intermediate conduits 90 may be disposed between the upstream conduit 22 and downstream conduit 24 with the support means 26 supporting the conduits 90 and maintaining a gap 28 between each of the adjacent conduits 22, 24, 90. The secondary fluid source 30 may be connected to any or all of the gaps for injecting secondary fluid into the gaps 28. Normally the same secondary fluid source 30 will be connected to all of the gaps 28, although distinct secondary fluid sources 30 may be connected to selected gaps 28 in order to inject secondary fluids of different composition, temperature, or pressure at the several gaps 28, as would be known to one skilled in the art in view of the disclosure contained herein. Only one upstream conduit 22 and downstream conduit 24 (with acceleration and deceleration nozzles 44, 64 and upstream and downstream throats 46, 66) are required as long as the velocity of the primary fluid is maintained sufficiently to sustain the fluid jet and essentially zero pressure exerted by the primary fluid on the walls of the upstream and downstream throats 46, 66 and intermediate throats 92. Additional upstream and downstream conduits 22, 24 can be added if needed to maintain the fluid velocity, as exemplified in FIG. 4. In all embodiments of the invention, the fluid user 58 should be selected or sized to allow fluid flow through the device 20 without causing undesired back pressure or vacuum in the throats 46, 66, 92 or in the gap(s) 28.

The support means 26 may be designed to allow rotation of any or all of the upstream, downstream, and intermediate conduits 22, 24, 90, as also would be known to one skilled in the art in view of the disclosure contained herein. It is contemplated, based on preliminary calculations, that 30 to 40% thermal volumetric contraction of the primary fluid at one gap 28 is a maximum range above which the enhanced efficiency of the invention decreases. Current calculations indicate that it will take three to four stages or gaps 28 upstream of a combustion gas driven engine to maximize the increased efficiency provided by the invention; and therefore a plurality of intermediate conduits 90 and/or injection devices 20 may be used with a combustion engine to cool a high temperature, high pressure combusted gas in several stages in order to optimize the efficiency of the engine by maximizing the cooling and mass injection at each gap 28 while minimizing the energy loss at each gap 28. It is contemplated that such an arrangement may be used to cool, add mass, and extract work from the combustion gas until it is cooled to an environmentally acceptable temperature.

Figure 6:
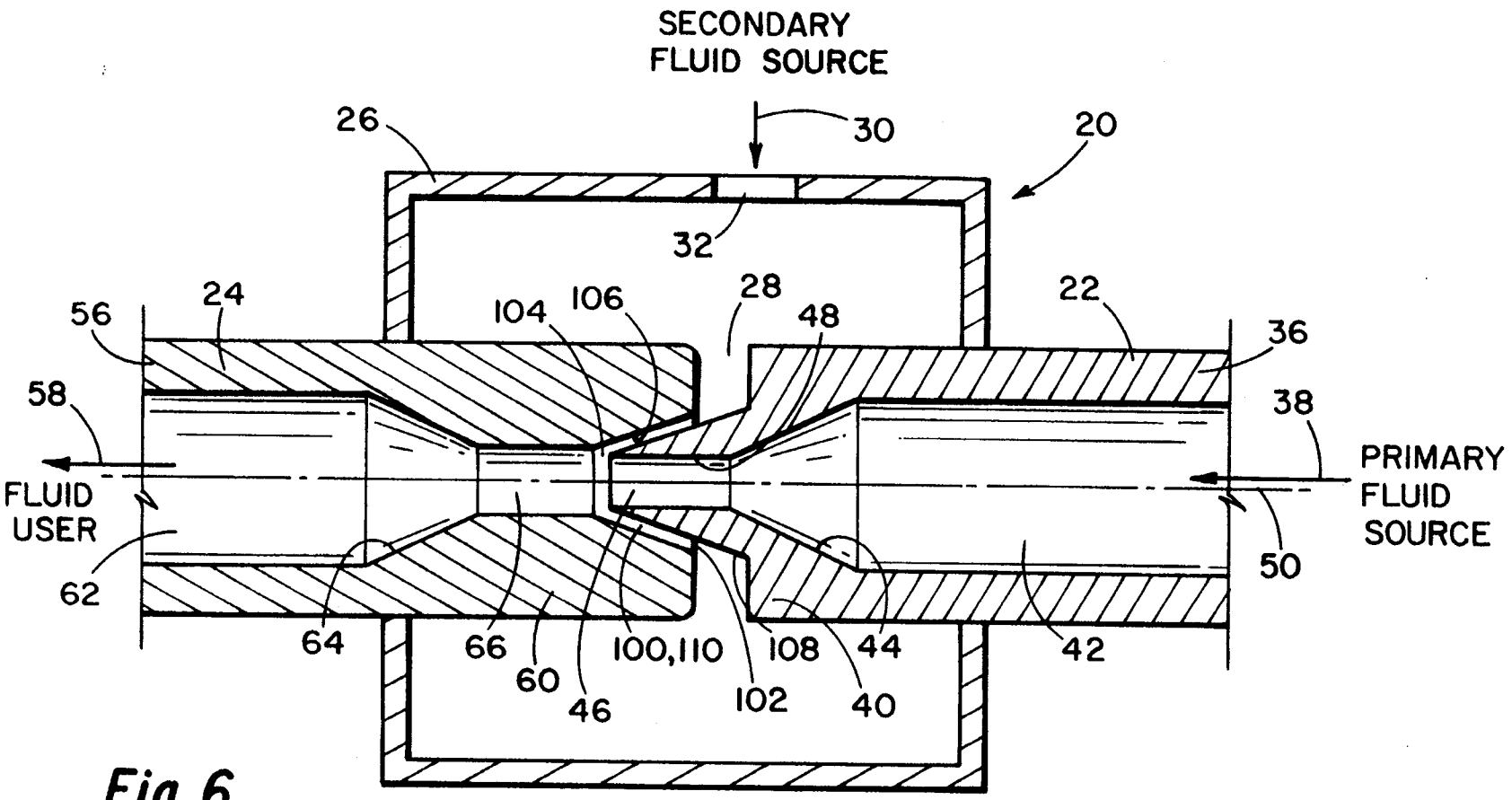
FIG. 6 is a schematic diagram of another embodiment of a fluid injection device of the present invention.

Referring to the example of FIG. 6, in a preferred embodiment, which may be used with any of the previously discussed embodiments, the gap 28 includes a secondary nozzle 100 for accelerating the velocity of the secondary fluid injected through the gap 28. The secondary nozzle 100 will improve the efficiency of the device 20 with any acceleration of the secondary fluid, although, preferably, the secondary nozzle accelerates the velocity of the secondary fluid to substantially the same velocity as the primary fluid exiting the upstream throat 46. The secondary nozzle 100 includes an inlet 102 and an outlet 104. Preferably, the outlet 104 discharges the accelerated secondary fluid into the downstream throat 66. It is contemplated that the secondary nozzle 100 and outlet 104 should be disposed to inject the secondary fluid in a direction as nearly parallel as possible to the flow of the primary fluid into the downstream throat 66 in order to maximize the energy efficiency of the injection. Referring to the example of FIG. 6, the secondary nozzle 100 includes an outside wall 106 located at the second end 60 of the downstream throat 66 and circumscribing the upstream throat; and an inside wall 108 located at and circumscribing the second end 40 of the upstream throat 46. The support means 26 supports the upstream and downstream conduit 22, 24 so as to maintain a fluid flow restricting annulus 110 between the outside and inside walls 106, 108 of the secondary nozzle 100.

Referring to the example of FIG. 6, in the prototype device 20, the outside wall 106 is formed in the second end 60 of the downstream conduit 24, extends between the second end 60 and the downstream throat 66, and is generally frustum-shaped. The inside wall 108 is connected to the second end 40 of the upstream conduit 22 and is a generally frustum-shaped extension of the second end 40 which surrounds the upstream throat 46. The annulus 110 is created by the positioning of the inside wall 108 within the outside wall 106. The annulus 110, pressure of the primary fluid source 50, and/or pressure of the secondary fluid source 30 should be designed or selected to match the velocity of the secondary fluid exiting the nozzle 100 to the velocity of the primary fluid exiting the upstream throat 46. The secondary nozzle 100 may be constructed in various configurations, as would be known to one skilled in the art in view of the disclosure contained herein. For example, the outside wall 106 could be a funnel or cone divergingly extending from the second end 40 of the downstream conduit 24; the inside wall 108 could be a cylindrical extension from the second end of the upstream conduit 22 which extends into the downstream throat 66 creating a cylindrical annulus between the inside wall 108 and outside wall 106/downstream throat 66. The gap 28 between the ends of the upstream and downstream conduit 22, 24 will normally communicate secondary fluid to the inlet 102 of the secondary nozzle 100 and should therefore be sized so that it does not interfere with the desired flow characteristics of the secondary nozzle 100.

Referring to the example of FIG. 1, the method of injecting a secondary fluid into a primary fluid includes accelerating the velocity of a primary fluid flowing in a upstream passageway 42 from a first end 36 through a second end 40 of an upstream conduit 22 to such a velocity that the pressure exerted by the primary fluid on the walls 48 of the upstream passageway 42 is substantially reduced; receiving the primary fluid discharged from the second end 40 of the upstream conduit 22 in a downstream passageway 62 in the second end of a downstream conduit 24 in which the downstream passageway 62 extends through the first end 56 of the downstream conduit 24; holding the upstream and downstream conduits 22, 24 with the passageways 42, 62 aligned; maintaining a gap 28 between the adjacent second ends 40, 60 of the upstream and downstream conduits 22, 24; injecting secondary fluid into the gap 28 and downstream conduit 24 at a preselected higher pressure than the primary fluid exiting the upstream conduit 22; and maintaining the fluid velocity in the downstream passageway 62 at substantially the same velocity as the velocity of the primary fluid exiting the upstream conduit.

The method provides for accelerating the velocity of the primary fluid in the upstream passageway 42 of the upstream conduit 22 using an acceleration nozzle 44 and maintaining the accelerated velocity of the primary fluid with an upstream throat 46 extending from the acceleration nozzle 44 to the second end 40 of the upstream conduit 22. The method provides for decelerating the velocity of the primary fluid using a deceleration nozzle 64 in the downstream passageway 62 of the downstream conduit 24 and maintaining the fluid flow velocity between the upstream throat 46 and the deceleration nozzle 64 with a downstream throat 66 extending from the second end 60 of the downstream conduit 24 to the deceleration nozzle 64.

Referring to example FIG. 5, the method provides for selecting the pressure and volume of the secondary fluid source 30 to inject secondary fluid into the primary fluid and intermediate and downstream throats 92, 66 via gaps 28 and thereby increase the volume and mass of the fluid passing through the intermediate and downstream throats 92, 66; and selectively enlarging the cross-sectional area of the intermediate and downstream throats 92, 66 and passageway 62 to accommodate the increased volume and mass of fluid flow in the intermediate and downstream throats 92, 66 and maintain the flow of the fluid passing through the intermediate and downstream throats 92, 66 at substantially the same velocity as the primary fluid exiting the upstream throat 46.

The method also provides for cooling the primary fluid exiting the upstream conduit 22 with the injected secondary fluid so that the cooled primary fluid volumetrically contracts as a result of the cooling. The method provides for selecting the volume and pressure of the secondary fluid so that the injected secondary fluid replaces the volume of the primary fluid lost due to thermal contraction and thereby increases the mass of fluid flowing through the downstream conduit 24 relative to the upstream conduit 22. The method also provides for selecting the volume and pressure of the secondary fluid to maintain the flow of the primary and injected secondary fluids through the downstream conduit 24 at substantially the same velocity as the primary fluid exiting the upstream conduit 22. The method further provides for selecting the cross-sectional area of the downstream passageway 62 of the downstream conduit 24 to maintain the flow of the primary and injected secondary fluids through the downstream conduit 24 at substantially the same velocity as the primary fluid exiting the upstream conduit 22.

The method further provides for selecting the pressure and volume of the secondary fluid to inject a greater volume of secondary fluid into the downstream conduit 24 than the thermal volumetric contraction of the primary fluid; and enlarging the cross-sectional area of the downstream passageway 62 of the downstream conduit 24 to maintain the flow of the primary and injected secondary fluids through the downstream conduit 24 at substantially the same velocity as the primary fluid exiting the upstream conduit 22.

Referring to example FIG. 4, the method further provides for connecting a plurality of the upstream and downstream conduits 22, 24 in series between a primary fluid source 38 and a fluid user 58 in such a manner that the second ends 40 of the upstream conduits 22 are always adjacent a second end 60 of a downstream conduit 24 with a gap 28 between the adjacent second ends 40, 60. In other words, the method provides for placing the upstream and downstream conduits 22, 24 end-to-end between a primary fluid source 38 and a fluid user 58 in order to create a series of gaps 28 between the primary fluid source 38 and fluid user 58. The method further provides for injecting secondary fluid into the gaps 28 in the series of upstream and downstream conduits 22, 24.

Referring to example FIG. 5, the method further provides for holding an intermediate conduit 90 having an intermediate throat 92 extending between an inlet end 94 and an outlet end 96 between the upstream conduit 22 and the downstream conduit 24 such that the inlet end 94 of the intermediate conduit 90 is aligned with the upstream passageway 42 of the upstream conduit 22, the outlet end 96 of the intermediate throat 92 is aligned with the downstream passageway 62 of the downstream conduit 24, a gap 28 is maintained between the upstream and intermediate conduits 22, 90, and a gap 28 is maintained between the downstream and intermediate conduits 24, 90; injecting secondary fluid into the gaps 28; receiving the accelerated fluid from the upstream conduit 22 and injected fluid in the inlet end 94 of the intermediate throat 92; and maintaining the received fluids at substantially the same velocity through the intermediate throat 92 as the primary fluid exiting the upstream conduit 22.

The method provides for selecting the pressure and volume of the secondary fluid to inject secondary fluid into the primary fluid and intermediate and downstream throats 92, 66 via the gaps 28 and increase the volume and mass of the fluid passing through the intermediate and downstream throats 92, 66; and selectively enlarging the cross-sectional area of the intermediate and downstream throats 92, 66 and passageway 62 in order to accommodate the increased volume and mass of fluid flow in the intermediate and downstream throats 92, 66 and to maintain the flow of fluid passing through the intermediate and downstream throats 92, 66 at substantially the same velocity as the primary fluid exiting the upstream throat.

The method also provides for cooling the fluid exiting the upstream and intermediate conduits 22, 90 with the injected secondary fluid so that the fluid exiting the upstream and intermediate conduits 22, 90 volumetrically contracts as a result of the cooling. The method provides for selecting the volume and pressure of the secondary fluid so that the injected secondary fluid replaces the volume of fluid lost due to thermal contraction at each gap 28 and thereby increases the mass of fluid flow at each gap through the intermediate and downstream throats 92, 66. The method further provides for selecting the volume and pressure of the secondary fluid to maintain the fluid flow velocity through the intermediate and downstream throats 92, 66 at substantially the same velocity as the fluid exiting the upstream throat 46. The method provides for selecting the volume and pressure of the secondary fluid to inject a greater volume of secondary fluid at each gap 28 than the volume of fluid lost due to thermal volumetric contraction and thereby increase the mass of fluid flow at each gap through the intermediate and/or downstream throats 92, 66; and selecting the cross-sectional area of each of the intermediate and downstream throats 92, 66 and passageway 62 to maintain the flow through the intermediate and downstream throats 92, 66 at substantially the same velocity as the fluid exiting the upstream throat 46.

The method also provides for holding a plurality of intermediate conduits 90 end-to-end, or in an outlet end 96 to inlet end 94 alignment, between the upstream conduit 22 and the downstream conduit 24 and maintaining a gap 28 between each of the adjacent ends 94, 96, as best exemplified in FIG. 5. The method provides for injecting secondary fluid into the gaps 28 of the sequentially placed upstream, downstream, and intermediate conduits 22, 24, 90.

The method also provides for rotatably mounting any or all of the upstream, downstream, and intermediate conduits 22, 24, 90. The method further provides for discharging the fluid exiting the downstream conduit 24 to cause rotation of the downstream conduit 24. The method further provides for transferring the rotational energy of the downstream conduit to an energy user 58.

The method also provides for accelerating the velocity of the secondary fluid injected through the gap 28 using secondary nozzle 100, as best exemplified in FIG. 6. Preferably, the secondary fluid is accelerated to substantially the same velocity as the primary fluid exiting the upstream throat 46. The method includes discharging the accelerated fluid into the downstream throat. The method further provides for accelerating the secondary fluid using a fluid flow restricting annulus 110 which is maintained between the inside and outside walls 106, 108 of the secondary nozzle 100 by the support means 26.

While presently preferred embodiments of the invention have been described herein for the purpose of disclosure, numerous changes in the construction and arrangement of parts and the performance of steps will suggest themselves to those skilled in the art in view of the disclosure contained herein, which changes are encompassed within the spirit of this invention, as defined by the following claims.

What is claimed is:

1. A fluid injection device for injecting a secondary fluid into a primary fluid, comprising:

(a) an upstream conduit having a first end connectable to a primary fluid source, a second end, and an upstream passageway extending through the first and second ends, the upstream passageway comprising:

an acceleration nozzle disposed in the upstream passageway for accelerating the velocity of the fluid flow so that the pressure exerted by the primary fluid on the walls of the upstream passageway is substantially reduced; and an upstream throat, extending between the acceleration nozzle and the second end of the upstream conduit, for maintaining the accelerated velocity of the fluid flow from the acceleration nozzle;

(b) a downstream conduit having a first end connectable to a fluid user, a second end, and a downstream passageway extending through the first and second ends, the downstream passageway comprising:

a deceleration nozzle disposed in the downstream passageway for decelerating the velocity of the fluid flow; and a downstream throat, extending between the deceleration nozzle and the second end of the downstream conduit, for receiving the accelerated fluid from the upstream throat and the injected secondary fluid, the cross-sectional areas of the downstream throat and passageway being selected to maintain the flow of the received fluids through the downstream throat at substantially the same velocity as the velocity of the primary fluid exiting the upstream throat;

(c) support means for holding the upstream and downstream conduits with the upstream and downstream throats aligned and for maintaining a gap between the upstream and downstream conduits and between the upstream and downstream throats; and (d) a secondary fluid source connectable to the gap for injecting secondary fluid into the gap and downstream throat at a preselected higher pressure than the primary fluid exiting the upstream throat.

2. Device of claim 1:

wherein the primary fluid is relatively hot and the secondary fluid is relatively cool and the primary fluid exiting the upstream throat volumetrically contracts when cooled by the injected secondary fluid.

3. Device of claim 1:

wherein the pressure of the secondary fluid source is less than the pressure of the primary fluid source.

4. Device of claim 1:

wherein the pressure and volume of the secondary fluid source are selected to inject secondary fluid into the primary fluid and downstream throat and increase the volume and mass of the fluid passing through the downstream throat; and wherein the cross-sectional areas of the downstream throat and passageway are enlarged in order to accommodate the increased volume and mass of fluid in the downstream throat and to maintain the flow of the fluid through the downstream throat at substantially the same velocity as the primary fluid exiting the upstream throat.

5. A fluid injection device for injecting a secondary fluid into a primary fluid, comprising:

(a) an upstream conduit having a first end connectable to a primary fluid source, a second end, and an upstream passageway extending through the first and second ends, the upstream passageway comprising:

an acceleration nozzle disposed in the upstream passageway for accelerating the velocity of the fluid flow so that the pressure exerted by the primary fluid on the walls of the upstream passageway is substantially reduced; and an upstream throat, extending between the acceleration nozzle and the second end of the upstream conduit, for maintaining the accelerated velocity of the fluid flow from the acceleration nozzle;

(b) a downstream conduit having a first end connectable to a fluid user, a second end, and a downstream passageway extending through the first and second ends, the downstream passageway comprising:

a deceleration nozzle disposed in the downstream passageway for decelerating the velocity of the fluid flow; and a downstream throat, extending between the deceleration nozzle and the second end of the downstream conduit, for receiving the accelerated fluid from the upstream throat and the injected secondary fluid and maintaining the received fluids at substantially the same velocity as the velocity of the primary fluid exiting the upstream throat;

(c) support means for holding the upstream and downstream conduits with the upstream and downstream throats aligned and for maintaining a gap between the upstream and downstream conduits and between the upstream and, downstream throats;

(d) a secondary fluid source connectable to the gap for injecting secondary fluid into the gap and downstream throat at a preselected higher pressure than the primary fluid exiting the upstream throat; and (e) wherein the primary fluid is relatively hot and the secondary fluid is relatively cool and the primary fluid exiting the upstream throat volumetrically contracts when cooled by the injected secondary fluid; and (f) wherein the volume and pressure of the secondary fluid source are selected so that the injected secondary fluid replaces the volume of primary fluid lost due to thermal contraction and thereby increases the mass of fluid flowing through the downstream throat relative to the upstream throat.

6. Device of claim 5:

wherein the volume and pressure of the secondary fluid source are selected to maintain the flow of the primary and injected secondary fluids through the downstream throat at substantially the same velocity as the primary fluid exiting the upstream throat,

7. Device of claim 5:

wherein the cross-sectional areas of the downstream throat and passageway are selected to maintain the flow of the primary and injected secondary fluids through the downstream throat at substantially the same velocity as the primary fluid exiting the upstream throat.

8. Device of claim 5:

wherein the pressure and volume of the secondary fluid source are selected to inject a greater volume of secondary fluid into the downstream throat than the volumetric contraction of the primary fluid; and wherein the cross-sectional areas of the downstream throat and passageway are selected to maintain the flow of the primary and injected secondary fluids through the downstream throat at substantially the same velocity as the primary fluid exiting the upstream throat.

9. Device of claim 5:

wherein the pressure of the secondary fluid source is less than the pressure of the primary fluid source.

10. A fluid injection device for injecting a secondary fluid into a primary fluid, comprising:

(a) an upstream conduit having a first end connectable to a primary fluid source, a second end, and an upstream passageway extending through the first and second ends, the upstream passageway comprising:

an acceleration nozzle disposed in the upstream passageway for accelerating the velocity of the fluid flow so that the pressure exerted by the primary fluid on the walls of the upstream passageway is substantially reduced; and an upstream throat, extending between the acceleration nozzle and the second end of the upstream conduit, for maintaining the accelerated velocity of the fluid flow from the acceleration nozzle;

(b) a downstream conduit having a first end connectable to a fluid user, a second end, and a downstream passageway extending through the first and second ends, the downstream passageway comprising:

a deceleration nozzle disposed in the downstream passageway for decelerating the velocity of the fluid flow; and a downstream throat, extending between the deceleration nozzle and the second end of the downstream conduit, for receiving the accelerated fluid from the upstream throat and the injected secondary fluid and maintaining the received fluids at substantially the same velocity as the velocity of the primary fluid exiting the upstream throat;

(c) support means for holding the upstream and downstream conduits with the upstream and downstream throats aligned and for maintaining a gap between the upstream and downstream conduits and between the upstream and downstream throats;

(d) a secondary fluid source connectable to the gap for injecting secondary fluid into the gap and downstream throat at a preselected higher pressure than the primary fluid exiting the upstream throat; and (e) wherein a plurality of the fluid injection devices are connected in series in such a manner that the downstream conduit of the adjacent upstream injection device is the primary fluid source for the upstream conduit of the adjacent downstream injection device.

11. Device of claim 10:

wherein the secondary fluid source is connectable to the gaps of all of the injection devices for injecting secondary fluid into the gaps.

12. A fluid injection device for injecting a secondary fluid into a primary fluid, comprising:

(a) an upstream conduit having a first end connectable to a primary fluid source, a second end, and an upstream passageway extending through the first and second ends, the upstream passageway comprising:

an acceleration nozzle disposed in the upstream passageway for accelerating the velocity of the fluid flow so that the pressure exerted by the primary fluid on the walls of the upstream passageway is substantially reduced; and an upstream throat, extending between the acceleration nozzle and the second end of the upstream conduit, for maintaining the accelerated velocity of the fluid flow from the acceleration nozzle;

(b) a downstream conduit having a first end connectable to a fluid user, a second end, and a downstream passageway extending through the first and second ends, the downstream passageway comprising:

a deceleration nozzle disposed in the downstream passageway for decelerating the velocity of the fluid flow; and a downstream throat, extending between the deceleration nozzle and the second end of the downstream conduit, for receiving the accelerated fluid from the upstream throat and the injected secondary fluid and maintaining the received fluids at substantially the same velocity as the velocity of the primary fluid exiting the upstream throat;

(c) support means for holding the upstream and downstream conduits with the upstream and downstream throats aligned and for maintaining a gap between the upstream and downstream conduits and between the upstream and downstream throats; and (d) a secondary fluid source connectable to the gap for injecting secondary fluid into the gap and downstream throat at a preselected higher pressure than the primary fluid exiting the upstream throat; and (e) wherein the support means is further defined as allowing rotation of either or both of the upstream and downstream conduits.

13. Device of claim 12, in which the fluid user comprises:

at least one thrust nozzle disposed for discharging the fluid exiting the downstream conduit and causing rotation of the downstream conduit.

14. Device of claim 13, comprising:

transfer means for transferring the rotational energy of the downstream conduit to an energy user.

15. A fluid injection device for injecting a secondary fluid into a primary fluid, comprising:

(a) an upstream conduit having a first end connectable to a primary fluid source, a second end, and an upstream passageway extending through the first and second ends, the upstream passageway comprising:

an acceleration nozzle disposed in the upstream passageway for accelerating the velocity of the fluid flow so that the pressure exerted by the primary fluid on the walls of the upstream passageway is substantially reduced; and an upstream throat, extending between the acceleration nozzle and the second end of the upstream conduit, for maintaining the accelerated velocity of the fluid flow from the acceleration nozzle;

(b) a downstream conduit having a first end connectable to a fluid user, a second end, and a downstream passageway extending through the first and second ends, the downstream passageway comprising:

a deceleration nozzle disposed in the downstream passageway for decelerating the velocity of the fluid flow; and a downstream throat, extending between the deceleration nozzle and the second end of the downstream conduit, for receiving the accelerated fluid from the upstream throat and the injected secondary fluid and maintaining the received fluids at substantially the same velocity as the velocity of the primary fluid exiting the upstream throat;

(c) support means for holding the upstream and downstream conduits with the upstream and downstream throats aligned and for maintaining a gap between the upstream and downstream conduits and between the upstream and downstream throats;

(d) a secondary fluid source connectable to the gap for injecting secondary fluid into the gap and downstream throat at a preselected higher pressure than the primary fluid exiting the upstream throat;

(e) an intermediate conduit having an intermediate throat extending between an inlet end and an outlet end disposed between the upstream conduit and the downstream conduit, the inlet end of the intermediate conduit receiving the accelerated fluid from the upstream throat and the injected fluid and maintaining the received fluids at substantially the same velocity through the intermediate throat as the primary fluid exiting the upstream conduit; and (f) wherein the support means is further defined as holding the intermediate conduit with the inlet end of the intermediate throat aligned with the upstream throat and the outlet end of the intermediate throat aligned with the downstream throat, as maintaining a gap between the upstream and intermediate conduits and throats, and as maintaining a gap between the downstream and intermediate conduits and throats; and (g) wherein the secondary fluid source is connectable to the gaps for injecting secondary fluid into the gaps.

16. Device of claim 15: wherein the fluid exiting the upstream and intermediate conduits is relatively hot and volumetrically contracts when cooled by the relatively cool injected secondary fluid.

17. Device of claim 16: wherein the volume and pressure of the secondary fluid source are selected so that the injected secondary fluid replaces the volume of fluid lost due to thermal contraction at each gap and thereby increases the mass of fluid flow at each gap and through the intermediate and downstream throats.

18. Device of claim 17:

wherein the volume and pressure of the secondary fluid source are selected to maintain the fluid flow velocity through the intermediate and downstream throats at substantially the same velocity as the fluid exiting the upstream throat.

19. Device of claim 17:

wherein the cross-sectional area of each of the intermediate and downstream throats and the downstream passageway is selected to maintain the fluid flow velocity through the intermediate and downstream throats at substantially the same velocity as the fluid exiting the upstream throat.

20. Device of claim 16:

wherein the volume and pressure of the secondary fluid source are selected to inject a greater volume of secondary fluid at each gap than the volume of fluid lost due to thermal volumetric contraction and to thereby increase the mass of fluid flow at each gap and through the intermediate and downstream throats; and wherein the cross-sectional area of each of the intermediate and downstream throats and the downstream passageway is selected to maintain the flow through the intermediate and downstream throats at substantially the same velocity as the fluid exiting the upstream throat.

21. Device of claim 15:

wherein the support means is further defined as allowing rotation of any or all of the upstream, downstream, and intermediate conduits.

22. Device of claim 21 in which the fluid user comprises:

at least one thrust nozzle disposed for discharging the fluid exiting the downstream conduit and causing rotation of the downstream conduit.

23. Device of claim 22, comprising:

transfer means for transferring the rotational energy of the downstream conduit to an energy user.

24. Device of claim 15, comprising:

a plurality of intermediate conduits disposed between the upstream conduit and the downstream conduit; and wherein the support means is further defined as maintaining a gap between each of the adjacent conduits.

25. Device of claim 24:

wherein the secondary fluid source is connectable to all of the gaps for injecting secondary fluid into the gaps.

26. Device of claim 15:

wherein the pressure of the secondary fluid source is less than the pressure of the primary fluid source.

27. Device of claim 15:

wherein the cross-sectional area of each of the intermediate and downstream throats and the downstream passageway is selected to maintain the flow through the intermediate and downstream throats at substantially the same velocity as the fluid exiting the upstream throat.

28. Device of claim 27:

wherein the pressure and volume of the secondary fluid source are selected to inject secondary fluid into the primary fluid, intermediate, and downstream throats and increase the volume and mass of the fluid passing through the intermediate and downstream throats; and wherein the cross-sectional areas of the intermediate and downstream throats and the downstream passageway are enlarged in order to accommodate the increased volume and mass of fluid in the intermediate and downstream throats and to maintain the flow of the fluid passing through the intermediate and downstream throats at substantially the same velocity as the primary fluid exiting the upstream throat.

29. A fluid injection device for injecting a secondary fluid into a primary fluid, comprising:

(a) an upstream conduit having a first end connectable to a primary fluid source, a second end, and an upstream passageway extending through the first and second ends, the upstream passageway comprising:

an acceleration nozzle disposed in the upstream passageway for accelerating the velocity of the fluid flow so that the pressure exerted by the primary fluid on the walls of the upstream passageway is substantially reduced; and an upstream throat, extending between the acceleration nozzle and the second end of the upstream conduit, for maintaining the accelerated velocity of the fluid flow from the acceleration nozzle;

(b) a downstream conduit having a first end connectable to a fluid user, a second end, and a downstream passageway extending through the first and second ends, the downstream passageway comprising:

a deceleration nozzle disposed in the downstream passageway for decelerating the velocity of the fluid flow; and a downstream throat, extending between the deceleration nozzle and the second end of the downstream conduit, for receiving the accelerated fluid from the upstream throat and the injected secondary fluid and maintaining the received fluids at substantially the same velocity as the velocity of the primary fluid exiting the upstream throat;

(c) support means for holding the upstream and downstream conduits with the upstream and downstream throats aligned and for maintaining a gap between the upstream and downstream conduits and between the upstream and downstream throats;

(d) a secondary fluid source connectable to the gap for injecting secondary fluid into the gap and downstream throat at a preselected higher pressure than the primary fluid exiting the upstream throat; and (e) a secondary nozzle for accelerating the velocity of the secondary fluid injected through the gap.

30. Device of claim 29:

wherein the secondary nozzle is further defined as accelerating the velocity of the secondary fluid to substantially the same velocity as the primary fluid exiting the upstream throat.

31. Device of claim 29 in which the secondary nozzle includes an inlet and an outlet and in which the outlet discharges the accelerated secondary fluid into the downstream throat.

32. Device of claim 29 in which the secondary nozzle comprises:

an outside wall located at the second end of the downstream throat and circumscribing the upstream throat; and an inside wall located at and circumscribing the second end of the upstream throat; and wherein the support means is defined as maintaining a fluid flow restricting annulus between the outside and inside walls of the nozzle.

33. A method of injecting a secondary fluid into a primary fluid, comprising:

(a) accelerating the velocity of a primary fluid flowing in an upstream passageway from a first end through a second end of an upstream conduit so that the pressure exerted by the primary fluid on the walls of the upstream passageway is substantially reduced;

(b) receiving the primary fluid discharged from the second end of the upstream conduit in a downstream passageway in the second end of a downstream conduit, the downstream passageway extending through a first end of the downstream conduit;

(c) holding the upstream and downstream conduits with the upstream and downstream passageways aligned;

(d) maintaining a gap between the adjacent second ends of the upstream and downstream conduits;

(e) injecting secondary fluid into the gap and downstream conduit at a preselected higher pressure than the primary fluid exiting the upstream conduit; and (f) selecting the cross-sectional area of the downstream passageway to maintain the fluid velocity in the downstream passageway at substantially the same velocity as the velocity of the primary fluid exiting the upstream conduit.

34. Method of claim 33;

in which the upstream passageway comprises:

an acceleration nozzle for accelerating the velocity of the primary fluid; and an upstream throat, extending from the acceleration nozzle to the second end of the upstream conduit, for maintaining the accelerated velocity of the primary fluid; and in which the downstream passageway comprises: a deceleration nozzle for decelerating the velocity of the primary fluid; and a downstream throat, extending from the deceleration nozzle to the second end of the downstream conduit, for maintaining the fluid flow velocity between the upstream throat and the deceleration nozzle.

35. Method of claim 34, comprising:

selecting the pressure and volume of the secondary fluid to inject secondary fluid into the primary fluid and intermediate and downstream throats and increase the volume and mass of the fluid passing through the intermediate and downstream throats; and enlarging the cross-sectional areas of the intermediate and downstream throats and the downstream passageway to accommodate the increased volume and mass of fluid flow in the intermediate and downstream throats and to maintain the flow of the fluid passing through the intermediate and downstream throats at substantially the same velocity as the primary fluid exiting the upstream throat.

36. Method of claim 33, comprising:

cooling the primary fluid exiting the upstream conduit with the injected secondary fluid so that the cooled primary fluid volumetrically contracts as a result of the cooling.

37. Method of claim 33:

wherein the pressure of the injected secondary fluid is less than the pressure of the primary fluid prior to acceleration in the upstream conduit.

38. A method of injecting a secondary fluid into a primary fluid, comprising:

(a) accelerating the velocity of a primary fluid flowing in an upstream passageway from a first end through a second end of an upstream conduit so that the pressure exerted by the primary fluid on the walls of the upstream passageway is substantially reduced;

(b) receiving the primary fluid discharged from the second end of the upstream conduit in a downstream passageway in the second end of a downstream conduit, the downstream passageway extending through a first end of the downstream conduit;

(c) holding the upstream and downstream conduits with the upstream and downstream passageways aligned;

(d) maintaining a gap between the adjacent second ends of the upstream and downstream conduits;

(e) injecting secondary fluid into the gap and downstream conduit at a preselected higher pressure than the primary fluid exiting the upstream conduit;

(f) maintaining the fluid velocity in the downstream passageway at substantially the same velocity as the velocity of the primary fluid exiting the upstream conduit;

(g) cooling the primary fluid exiting the upstream conduit with the injected secondary fluid so that the cooled primary fluid volumetrically contracts as a result of the cooling; and (h) selecting the volume and pressure of the secondary fluid so that the injected secondary fluid replaces the volume of primary fluid lost due to thermal contraction and thereby increases the mass of fluid flowing through the downstream conduit relative to the upstream conduit.

39. Method of claim 38, comprising:

selecting the volume and pressure of the secondary fluid to maintain the flow of the primary and injected secondary fluids through the downstream conduit at substantially the same velocity as the primary fluid exiting the upstream conduit.

40. Method of claim 38, comprising:

selecting the cross-sectional area Of the downstream passageway to maintain the flow of the primary and injected secondary fluids through the downstream conduit at substantially the same velocity as the primary fluid exiting the upstream conduit.

41. Method of claim 38, comprising:

selecting the pressure and volume of the secondary fluid to inject a greater volume of secondary fluid into the downstream conduit than the thermal volumetric contraction of the primary fluid; and enlarging the cross-sectional area of the downstream passageway to maintain the flow of the primary and injected secondary fluids through the downstream conduit at substantially the same velocity as the primary fluid exiting the upstream conduit.

42. Method of claim 38, comprising:

wherein the pressure of the injected secondary fluid is less than the pressure of the primary fluid prior to acceleration in the upstream conduit.

43. A method of injecting a secondary fluid into a primary fluid, comprising:

(a) accelerating the velocity of a primary fluid flowing in an upstream passageway from a first end through a second end of an upstream conduit so that the pressure exerted by the primary fluid on the walls of the upstream passageway is substantially reduced;

(b) receiving the primary fluid discharged from the second end of the upstream conduit in a downstream passageway in the second end of a downstream conduit, the downstream passageway extending through a first end of the downstream conduit;

(c) holding the upstream and downstream conduits with the upstream and downstream passageways aligned;

(d) maintaining a gap between the adjacent second ends of the upstream and downstream conduits;

(e) injecting secondary fluid into the gap and downstream conduit at a preselected higher pressure than the primary fluid exiting the upstream conduit;

(f) maintaining the fluid velocity in the downstream passageway at substantially the same velocity as the velocity of the primary fluid exiting the upstream conduit; and (g) connecting a plurality of the upstream and downstream conduits in series in such a manner that the second ends of the upstream conduits are always adjacent a second end of a downstream conduit with a gap between the adjacent second ends.

44. Method of claim 43, comprising:

injecting secondary fluid into the gaps.

45. A method of injecting a secondary fluid into a primary fluid, comprising:

(a) accelerating the velocity of a primary fluid flowing in an upstream passageway from a first end through a second end of an upstream conduit so that the pressure exerted by the primary fluid on the walls of the upstream passageway is substantially reduced;

(b) receiving the primary fluid discharged from the second end of the upstream conduit in a downstream passageway in the second end of a downstream conduit, the downstream passageway extending through a first end of the downstream conduit;

(c) holding the upstream and downstream conduits with the upstream and downstream passageways aligned;

(d) maintaining a gap between the adjacent second ends of the upstream and downstream conduits;

(e) injecting secondary fluid into the gap and downstream conduit at a preselected higher pressure than the primary fluid exiting the upstream conduit;

(f) maintaining the fluid velocity in the downstream passageway at substantially the same velocity as the velocity of the primary fluid exiting the upstream conduit; and rotatably mounting either or both of the upstream and downstream conduits.

46. Method of claim 45, comprising:

directing the discharge of the fluid exiting the downstream conduit to cause rotation of the downstream conduit.

47. Method of claim 46, comprising:

transferring the rotational energy of the downstream conduit to an energy user.

48. A method of injecting a secondary fluid into a primary fluid, comprising:

(a) accelerating the velocity of a primary fluid flowing in an upstream passageway from a first end through a second end of an upstream conduit so that the pressure exerted by the primary fluid on the walls of the upstream passageway is substantially reduced;

(b) receiving the primary fluid discharged from the second end of the upstream conduit in a downstream passageway in the second end of a downstream conduit, the downstream passageway extending through a first end of the downstream conduit;

(c) holding an intermediate conduit having an intermediate throat extending between an inlet end and an outlet end between the upstream conduit and the downstream conduit such that the inlet end of the intermediate conduit is aligned with the upstream passageway of the upstream conduit, the outlet end of the intermediate throat is aligned with the downstream passageway of the downstream conduit, a gap is maintained between the upstream and intermediate conduits, and a gap is maintained between the downstream and intermediate conduits;

(d) injecting secondary fluid into the gaps at a preselected higher pressure than the primary fluid exiting the upstream conduit;

(e) receiving the accelerated fluid from the upstream conduit and injected fluid in the inlet end of the intermediate throat; and (f) maintaining the received fluids at substantially the same velocity through the intermediate throat and the downstream throat as the primary fluid exiting the upstream conduit.

49. Method of claim 48, comprising:

holding a plurality of intermediate conduits in an inlet end to outlet end sequence between the upstream conduit and the downstream conduit and maintaining a gap between each of the adjacent conduits.

50. Method of claim 49 comprising:

injecting secondary fluid into the gaps.

51. Method of claim 48, comprising:

rotatably mounting any or all of the upstream, downstream, and intermediate conduits.

52. Method of claim 51, comprising:

discharging the fluid exiting the downstream conduit to cause rotation of the downstream conduit.

53. Method of claim 52, comprising:

transferring the rotational energy of the downstream conduit to an energy user.

54. Method of claim 48;

in which the upstream passageway comprises:

an acceleration nozzle for accelerating the velocity of the primary fluid; and an upstream throat, extending from the acceleration nozzle to the second end of the upstream conduit, for maintaining the accelerated velocity of the primary fluid; and in which the downstream passageway comprises:

a deceleration nozzle for decelerating the velocity of the primary fluid; and a downstream throat, extending from the deceleration nozzle to the second end of the downstream conduit, for maintaining the fluid flow velocity between the upstream throat and the deceleration nozzle.

55. Method of claim 54, comprising:

selecting the volume and pressure of the secondary fluid so that the injected secondary fluid replaces the volume of fluid lost due to thermal contraction at each gap and thereby increases the mass of fluid flow at each gap and through the intermediate and downstream throats.

56. Method of claim 55, comprising:

selecting the volume and pressure of the secondary fluid to inject a greater volume of secondary fluid at each gap than the volume of fluid lost due to thermal volumetric contraction and to thereby increase the mass of fluid flow at each gap and through the intermediate and downstream throats; and selecting the cross-sectional areas of each of the intermediate and downstream throats and the downstream passageway to maintain the flow through the intermediate and downstream throats at substantially the same velocity as the fluid exiting the upstream throat.

57. Method of claim 56:

wherein the pressure of the injected secondary fluid is less than the pressure of the primary fluid upstream of the acceleration nozzle.

58. Method of claim 55, comprising:

selecting the volume and pressure of the secondary fluid to maintain the fluid flow velocity through the intermediate and downstream throats at substantially the same velocity as the fluid exiting the upstream throat.

59. Method of claim 55, comprising:

selecting the cross-sectional area of each of the intermediate and downstream throats and the downstream passageway to maintain the fluid flow velocity through the intermediate and downstream throats at substantially the same velocity as the fluid exiting the upstream throat.

60. Method of claim 58;

in which the upstream passageway comprises:

an acceleration nozzle for accelerating the velocity of the primary fluid; and an upstream throat, extending from the acceleration nozzle to the second end of the upstream conduit, for maintaining the accelerated velocity of the primary fluid; and in which the downstream passageway comprises: a deceleration nozzle for decelerating the velocity of the primary fluid; and a downstream throat, extending from the deceleration nozzle to the second end of the downstream conduit, for maintaining the fluid flow velocity between the upstream throat and the deceleration nozzle.

61. Method of claim 60, comprising:

selecting the cross-sectional area of each of the intermediate and downstream throats to maintain the flow through the intermediate and downstream throats at substantially the same velocity as the fluid exiting the upstream throat.

62. Method of claim 61, comprising:

selecting the pressure and volume of the secondary fluid to inject secondary fluid into the primary fluid and intermediate and downstream throats and increase the volume and mass of the fluid passing through the intermediate and downstream throats; and enlarging the cross-sectional areas of the intermediate and downstream throats and the downstream passageway in order to accommodate the increased volume and mass of fluid flow in the intermediate and downstream throats and to maintain the flow of the fluid passing through the intermediate and downstream throats at substantially the same velocity as the primary fluid exiting the upstream throat.

63. Method of claim 48, comprising:

cooling the fluid exiting the upstream and intermediate conduits with the injected secondary fluid so that the fluid exiting the upstream and intermediate conduits volumetrically contracts as a result of the cooling.

64. A method of injecting a secondary fluid into a primary fluid, comprising:

(a) accelerating the velocity of a primary fluid flowing in an upstream passageway from a first end through a second end of an upstream conduit so that the pressure exerted by the primary fluid on the walls of the upstream passageway is substantially reduced;

(b) receiving the primary fluid discharged from the second end of the upstream conduit in a downstream passageway in the second end of a downstream conduit, the downstream passageway extending through a first end of the downstream conduit;

(c) holding the upstream and downstream conduits with the upstream and downstream passageways aligned;

(d) maintaining a gap between the adjacent second ends of the upstream and downstream conduits;

(e) injecting secondary fluid into the gap and downstream conduit at a preselected higher pressure than the primary fluid exiting the upstream conduit;

(f) maintaining the fluid velocity in the downstream passageway at substantially the same velocity as the velocity of the primary fluid exiting the upstream conduit; and accelerating the velocity of the secondary fluid injected through the gap.

65. Method of claim 64, comprising:

accelerating the velocity of the secondary fluid to substantially the same velocity as the primary fluid exiting the upstream throat.

66. Method of claim 64, comprising:

discharging the accelerated .secondary fluid into the downstream passageway.

67. Method of claim 64 in which step (b) comprises:

maintaining a fluid flow restricting annulus in the gap between the upstream and downstream conduit.

68. A fluid injection device for injecting a secondary fluid into a primary fluid, comprising:

(a) an upstream conduit having a first end connectable to a primary fluid source, a second end, and an upstream passageway extending through the first and second ends, the upstream passageway comprising:

an acceleration nozzle disposed in the upstream passageway for accelerating the velocity of the fluid flow so that the pressure exerted by the primary fluid on the walls of the upstream passageway is substantially reduced; and an upstream throat, extending between the acceleration nozzle and the second end of the upstream conduit, for maintaining the accelerated velocity of the fluid flow from the acceleration nozzle;

(b) a downstream conduit having a first end connectable to a fluid user, a second end, and a downstream passageway extending through the first and second ends, the downstream passageway comprising:

a deceleration nozzle disposed in the downstream passageway for decelerating the velocity of the fluid flow; and a downstream throat, extending between the deceleration nozzle and the second end of the downstream conduit, for receiving the accelerated fluid from the upstream throat and the injected secondary fluid and maintaining the received fluids at substantially the same velocity as the velocity of the primary fluid exiting the upstream throat;

(c) support means for holding the upstream and downstream conduits with the upstream and downstream throats aligned and for maintaining a gap between the upstream and downstream conduits and between the upstream and downstream throats; and (d) a secondary fluid source connectable to the gap for injecting secondary fluid into the gap and downstream throat at a higher pressure than the primary fluid exiting the upstream throat, the volume and pressure of the secondary fluid source being selected to maintain the flow of the primary and injected secondary fluids through the downstream throat at substantially the same velocity as the primary fluid exiting the upstream throat.

69. Device of claim 68:

wherein the pressure of the secondary fluid source is less than the pressure of the primary fluid source.

70. A method of injecting a secondary fluid into a primary fluid, comprising:

(a) accelerating the velocity of a primary fluid flowing in an upstream passageway from a first end through a second end of an upstream conduit so that the pressure exerted by the primary fluid on the walls of the upstream passageway is substantially reduced;

(b) receiving the primary fluid discharged from the second end of the upstream conduit in a downstream passageway in the second end of a downstream conduit, the downstream passageway extending through a first end of the downstream conduit;

(c) holding the upstream and downstream conduits with the upstream and downstream passageways aligned;

(d) maintaining a gap between the adjacent second ends of the upstream and downstream conduits;

(e) injecting secondary fluid into the gap and downstream conduit at a higher pressure than the primary fluid exiting the upstream conduit; and (f) selecting the volume and pressure of the injected secondary fluid to maintain the fluid velocity in the downstream passageway at substantially the same velocity as the velocity of the primary fluid exiting the upstream conduit.

71. Method of claim 70:

wherein the pressure of the injected secondary fluid is less than the pressure of the primary fluid prior to acceleration in the upstream conduit.

* * * * *